US007690955B2

(12) United States Patent
Siebens et al.

(10) Patent No.: US 7,690,955 B2
(45) Date of Patent: Apr. 6, 2010

(54) BUSHING WELL WITH IMPROVED COUPLING COMPONENTS

(75) Inventors: Larry Siebens, Asbury, NJ (US); Alan Borgstrom, Hackettstown, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/454,673

(22) Filed: May 21, 2009

(65) Prior Publication Data

US 2009/0233496 A1 Sep. 17, 2009

Related U.S. Application Data

(63) Continuation of application No. 12/169,149, filed on Jul. 8, 2008, now Pat. No. 7,556,540.

(60) Provisional application No. 60/958,941, filed on Jul. 9, 2007.

(51) Int. Cl.
*H01R 4/30* (2006.01)

(52) U.S. Cl. ..... 439/801; 439/921

(58) Field of Classification Search ..... 439/320, 439/94, 170, 921, 475, 801, 805; 174/152 R
See application file for complete search history.

(56) References Cited

U.S. PATENT DOCUMENTS

| | | | | |
|---|---|---|---|---|
| 4,353,611 | A | 10/1982 | Siebens et al. | |
| 4,611,093 | A | 9/1986 | Farmer et al. | |
| 4,857,021 | A | 8/1989 | Boliver et al. | |
| 5,421,750 | A * | 6/1995 | Crotty | 439/801 |
| 6,939,151 | B2 | 9/2005 | Borgstrom et al. | |
| 7,491,075 | B2 | 2/2009 | Hughes et al. | |
| 7,556,540 | B2 * | 7/2009 | Siebens et al. | 439/801 |

* cited by examiner

*Primary Examiner*—T C Patel
*Assistant Examiner*—Phuong Nguyen
(74) *Attorney, Agent, or Firm*—Hoffmann & Baron, LLP

(57) ABSTRACT

A bushing well, which generally includes a bushing well housing defining a conical inner cavity for receiving an end of a bushing insert and an electrically conductive insert disposed within the housing, wherein the insert has an installation tool engagement portion accessible by an installation tool via the inner cavity of the housing for attaching the bushing well to an electrical device.

18 Claims, 8 Drawing Sheets

FIG. 2
(PRIOR ART)
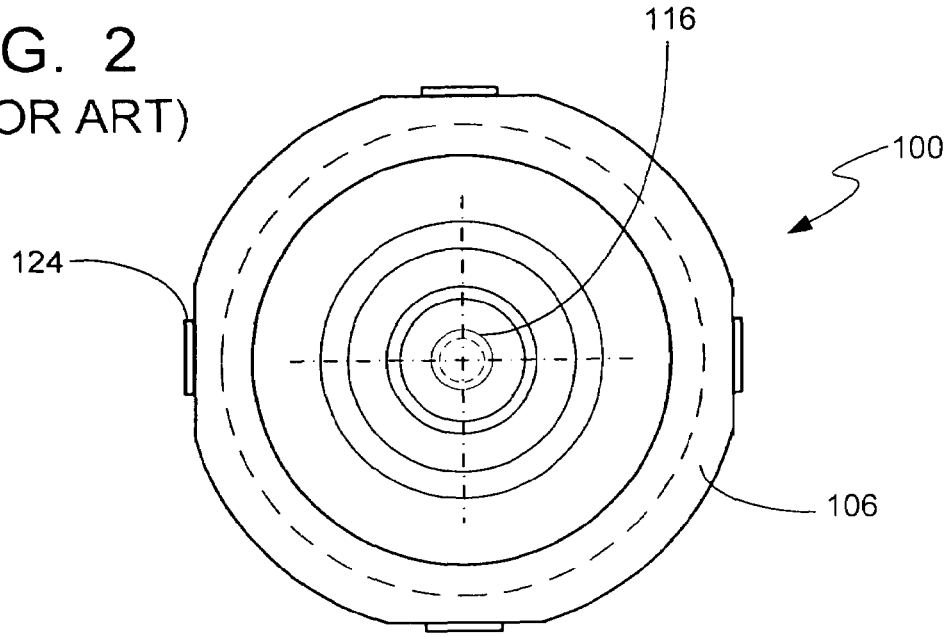
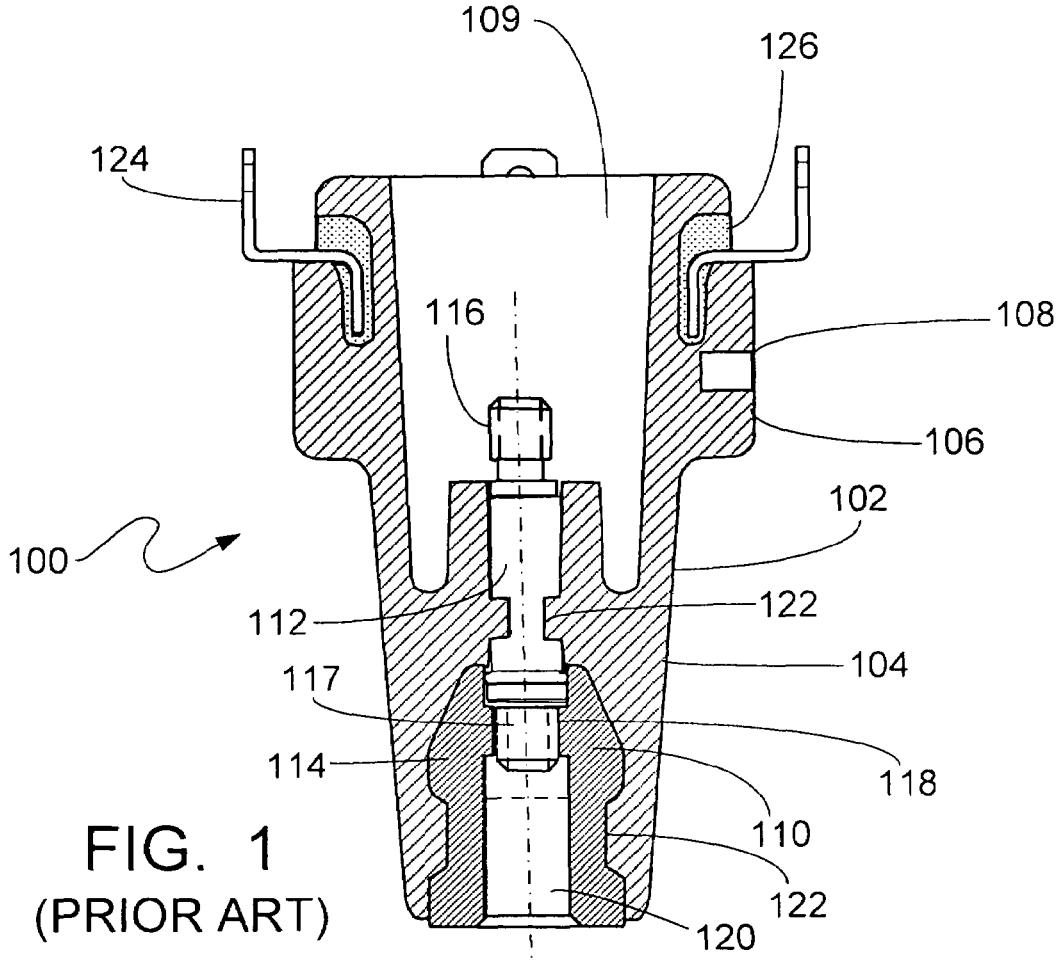
FIG. 1
(PRIOR ART)

BUSHING WELL WITH IMPROVED COUPLING COMPONENTS

CROSS-REFERENCE TO RELATED APPLICATIONS

This application is a continuation application of U.S. application Ser. No. 12/169,149, filed on Jul. 8, 2008, now U.S. Pat. No. 7,556,540 which claims the benefit of U.S. Provisional Application No. 60/958,941, filed on Jul. 9, 2007, both of which are incorporated by reference herein in their entirety for all purposes.

BACKGROUND OF THE INVENTION

The present invention relates generally to the construction of components employed in medium and high voltage electrical distribution systems and pertains, more specifically, to an improvement in the structure and arrangement of the coupling components of a bushing well in such an electrical distribution system.

Connections in underground power distribution systems, such as between cables and transformers, are generally accomplished with specially designed separable male and female electrical connectors, such as loadbreak connectors and deadbreak connectors. Such cable connectors, used in conjunction with 15, 25 and 35 kV systems, generally include a power cable elbow connector and a bushing insert. The elbow connector has one end adapted for receiving a power cable and another end adapted for receiving an insertion end of the bushing insert. The opposite end of the bushing insert, which extends outward from the elbow connector, may in turn be received in a bushing well of a transformer, for example.

Currently, most bushing wells are constructed with an integral threaded stud which is unitary with the electrical contact element of the bushing well. At one end, the stud serves as a threaded connector for mechanically coupling and electrically connecting a bushing insert to the bushing well. At its opposite end, the stud is provided with another threaded connection for further connecting the well to another electrical component, such as a transformer. Bushing wells are typically mounted within such other electrical components by applying a wrench, such as a spanner wrench, around an external shoulder portion of the well and rotating the well so that the stud threadably engages the electrical component.

One drawback with these prior art bushing wells is the damage sometimes caused by the tool applied to the outer surface of the well during installation. In particular, application of a spanner wrench often causes chipping or cracking of the metalized epoxy material on the shoulder portion and other surfaces of the well that are critical to sealing.

Another drawback is that during assembly of the bushing insert with the bushing well, the threaded connection between the components sometimes is over tightened, resulting in the stud breaking from the electrical contact element. In addition, in disassembling a bushing insert from a bushing well, the threaded connection sometimes is found to be seized and the result, once again, is a severing of the threaded stud from the electrical contact element of the bushing well. In other instances, the thread of the stud has become damaged, as by galling, thus rendering the stud useless in attaining the desired coupling and connection. In each of these instances the end result is a requirement for replacement of the entire bushing well, leading to considerable down-time in the electrical distribution system and considerable extra expense.

Other drawbacks with bushing wells of the prior art relate to the problems encountered during manufacturing. Typically, these connectors are made by transfer molding of an epoxy material. Epoxy molding is expensive and it is often difficult to attain a good bond with other essential rubber and metal components. Moreover, as mentioned above, metalized epoxy surfaces are prone to chipping and cracking during installation and are easily damaged if the bushing well is dropped or bumped against other hard surfaces. Furthermore, as compared to rubber, metalized epoxy is not as desirable in a wet environment.

Accordingly, it would be desirable to provide a bushing well that can be installed on or mounted within another electrical component with minimal risk of damaging or marring critical surfaces of the well. It would also be advantageous to provide a bushing well stud which enables simplified removal and replacement of a damaged or broken stud without requiring replacement of the entire bushing well. It would be further desirable to provide a bushing well with reduced manufacturing costs and that will be less prone to damage when handling.

OBJECTS AND SUMMARY OF THE INVENTION

It is an object of the present invention to provide an improved bushing well that is easily installed in an electrical component without having to apply a tool to an outer surface of the well.

It is another object of the present invention to provide an improved bushing well stud construction in which the threaded stud is removably secured to the electrical contact element of the bushing well so as to be selectively replaceable without disturbing the installed bushing well.

Still another object of the present invention is to reduce the amount of metalized epoxy material required to mold a bushing well thereby reducing the cost of the final product and also minimizing the possibility of chipping on the outer surface of the well.

A further object of the present invention is to provide an improved bushing well of the type described and which is compatible with bushing inserts now in use in the field so as to enable immediate, widespread use of the improvement as a direct replacement for currently available bushing wells.

In the efficient attainment of these and other objects, the present invention provides a bushing well, which generally includes a bushing well housing defining a conical inner cavity for receiving an end of a bushing insert and an electrically conductive insert disposed within the housing, wherein the insert has an installation tool engagement portion accessible by an installation tool via the inner cavity of the housing for attaching the bushing well to an electrical device.

In a preferred embodiment, the electrically conductive insert is a tubular member having an axial bore therethrough. The axial bore defines a wrenching passage having a hexagonal internal cross-section providing a wrenching socket.

In an alternative embodiment, the electrically conductive insert includes a tubular member having an axial bore therethrough and an assembly bolt disposed within the axial bore of the tubular member, wherein the assembly bolt has the installation tool engagement portion.

In either case, the bushing well further preferably includes an externally threaded replaceable well stud removably attached to either the conductive insert or the assembly bolt. Also, the housing preferably includes a conically shaped insertion end made substantially of an insulating rubber and a shoulder portion made substantially of a semi-conductive rubber.

The present invention further involves a method for securing a bushing well to an electrical device. The method generally includes the steps of inserting a conically shaped insertion end of the bushing well into a mating connector of the electrical device, inserting an installation tool into a conically shaped internal cavity of the well, engaging the installation tool with an installation tool engagement portion provided on an electrically conductive insert disposed within the bushing well and rotating the installation tool to threadably engage the bushing well with the electrical device.

The installation tool engagement portion is preferably defined by a wrenching passage provided in an axial bore of the conductive insert, and the wrenching passage preferably has a hexagonal internal cross-section providing a wrenching socket. Also, the method preferably includes the step of threadably engaging an externally threaded replaceable well stud with the conductive insert disposed within the bushing well.

A preferred form of the bushing well, as well as other embodiments, objects, features and advantages of this invention, will be apparent from the following detailed description of illustrative embodiments thereof, which is to be read in conjunction with the accompanying drawings.

BRIEF DESCRIPTION OF THE DRAWINGS

FIG. 1 is a cross-sectional view of a bushing well of the prior art.

FIG. 2 is a top plan view of the bushing shown in FIG. 1.

DETAILED DESCRIPTION OF THE PREFERRED EMBODIMENTS

Figure 3:
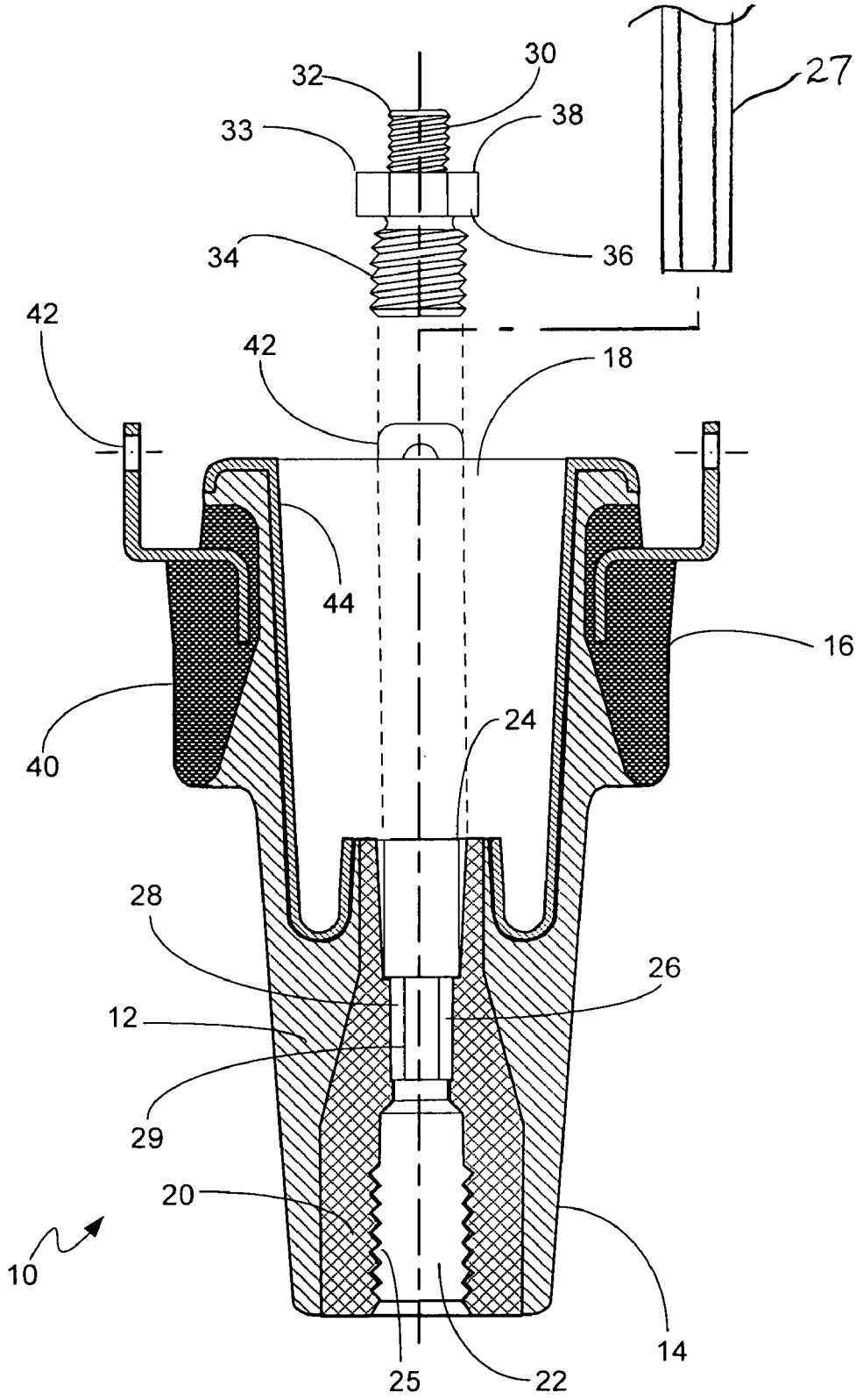
FIG. 3 is a cross-sectional view of a preferred embodiment of a bushing well formed in accordance with the present invention.

Referring first to FIGS. 1 and 2, a prior art bushing well 100 is illustrated. The bushing well 100 generally includes a housing 102 molded from a metalized epoxy material. The housing 102 includes a conically shaped insertion end 104, which is sized to be received within an apparatus face plate (not shown) of an electrical device, such as a power transformer, or within an elbow cuff of an elbow connector (not shown). The housing 102 further includes a shoulder portion 106 having one or more radial openings 108, which are adapted to receive an installation tool, such as a spanner wrench. The housing 102 further defines a conically shaped internal cavity 109, which is adapted to receive the conically shaped end of a bushing insert (not shown).

Integrally molded within the conically shaped insertion end 104 of the housing 102 is an electrical contact assembly 110. The electrical contact assembly 110 includes a stud member 112 and a contact insert 114. The stud member 112 is generally a cylindrical rod having externally threaded opposite ends 116, 117. A first externally threaded end 116 of the stud member 112 is adapted to engage an internally threaded component of the bushing insert. A second externally threaded end 117, opposite the first end 116, is provided for engagement with the contact insert 114. In this regard, the contact insert 114 is provided with an internally threaded opening 118 adapted to threadably engage the second end 117 of the stud member 112 upon assembly. The contact insert 114 further defines an internally threaded receptacle 120 adapted to receive an externally threaded electrical terminal (not shown) of the electrical component to which the well 100 is installed.

The stud member 112 and the contact insert 114 are pre-assembled together, as described above, to form the electrical contact assembly 110 and the housing 102 is subsequently molded around the assembly to form an integral well. The stud member 112 and/or the contact insert 114 may include one or more flats or recesses 122 to enhance the encapsulation of the electrical contact assembly 110 within the molded material of the insertion end 104 of the housing 102.

The shoulder portion 106 may further be provided with one or more integrally molded bail tabs 124 adapted to engage a hold down bail to enhance attachment between the well 100, the bushing insert and the elbow. The bail tabs 124 are typically molded within a rubber material ring 126 integrally molded within the shoulder portion 106 of the housing 102.

Upon installation, the bushing well 100 is typically hand-tightened to the threaded end of an electrical component. A finger of an installation tool, such as a spanner wrench, is then inserted in the opening 108 of the housing shoulder portion 106 and the tool is applied to rotate the housing 102 and further tighten the well 100 to the electrical component. A bushing insert is then inserted within the cavity 109 and threadably secured to the well. As described above, a major drawback with prior art bushing wells is the tendency of the installation tool to cause damage to the outer surface of the shoulder portion 106 of the housing 102 during installation.

Figure 5:
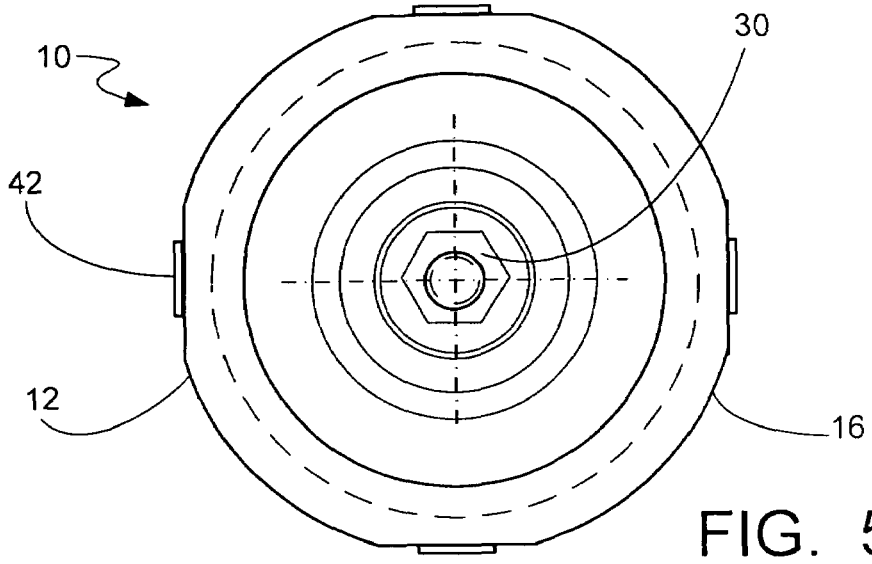
FIG. 5 is a top plan view of the bushing well shown in FIG. 4.
Figure 4:
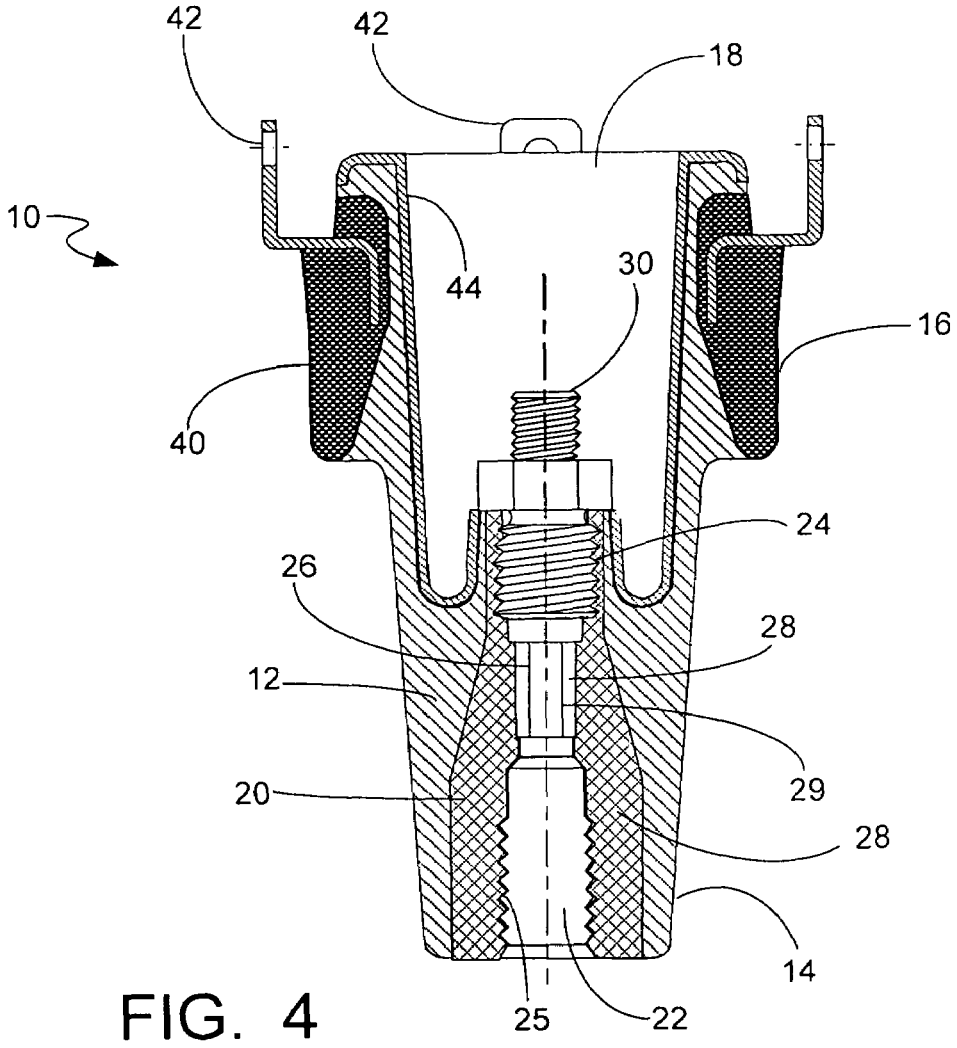
FIG. 4 is a cross-sectional view of the bushing well shown in FIG. 3 with the replaceable well stud installed therein.

Turning now to FIGS. 3-5, a preferred embodiment of a bushing well 10 formed in accordance with the present invention is shown. The bushing well 10 of the present invention includes a housing 12 molded from an EPDM insulating rubber. The housing 12 includes a conically shaped insertion end 14, which conforms to IEEE Standard 386 so as to be received within a mating connector, as described above with respect to prior art well 100. The housing 12 further similarly includes a shoulder portion 16 and defines a conically shaped internal cavity 18, which conforms to IEEE Standard 386 so as to receive the conically shaped end of a bushing insert (not shown).

The housing 12 of the present invention includes an integrally molded contact insert 20, which is specially designed to engage an installation tool for assembling the well 10 to an electrical device. More particularly, in a preferred embodiment, the contact insert 20 is a tubular member made from an electrically conductive material, such as aluminum or copper. The insert 20 is permanently encapsulated or embedded within the insulative rubber forming the insertion end 12 of the housing, so as to be integral therewith, and includes an axial bore 22 extending therethrough. The axial bore 22 includes a first internally threaded end portion 24, a second internally threaded end portion 25 opposite the first portion and a central installation tool engagement portion 26 disposed between the opposite first and second end portions.

The first internally threaded end portion 24 is adapted to threadably engage a replaceable well stud 30, as will be discussed in further detail below. The second internally threaded end portion 25 is adapted to threadably engage an externally threaded electrical terminal (not shown) of the electrical device to which the well 10 is installed. The central installation tool engagement portion 26 is adapted to engage an installation tool, such as an alien wrench, for rotating the well 10 so as to connect the well to an electrical device. Specifically, the central installation tool engagement portion 26 is defined by a wrenching passage 28 having a hexagonal internal cross-sectional configuration providing a wrenching socket 29 in the internal passage. Such wrenching socket 29 can take the form of a ⅜" hex broach to receive a standard ⅜" allen wrench.

Upon installation, an installation tool (not shown) is passed through the conical cavity 18 of the well 10 and inserted into the axial bore 22 of the contact insert 20. The key end of the tool is received within the internal passage 28 of the engagement portion 26 and engages the wrenching socket 29. The tool can then be driven so as to rotate the contact insert 20, and in turn rotate the entire well 10. As the well 10 is rotated, the internally threaded second end portion 25 threadably engages an electrical terminal of the electrical device to secure the well to the device.

As mentioned above, the well 10 of the present invention further includes a replaceable well stud 30, which is assembled to the contact insert 20 after the well is mounted to the electrical device. As will be discussed in further detail below, the replaceable well stud 30 not only provides selective access and closure of the wrenching passage 28, but it also alleviates the problem of replacing the entire bushing well should the well stud become damaged.

The replaceable well stud 30 is a generally cylindrical member having a first externally threaded end portion 32, a mid-section 33 and a second externally threaded end portion 34 opposite the first end portion. The first externally threaded end portion 32 is adapted to engage an internally threaded component of the bushing insert. The opposite second externally threaded end portion 34 is adapted to threadably engage the first internally threaded end portion 24 of the contact insert 20. The mid-section 33 is wider than the second end portion 34 so that the mid-section will act as a stop to prevent further threadable insertion of the stud 30 into the contact insert 20.

The well stud 30 further includes a tool engagement portion 36 for engagement with a tool to tighten the well stud to the contact insert 20. In a preferred embodiment, the well stud tool engagement portion 36 takes the form of a hexagonal shoulder portion 38 disposed on the mid-section 33 between the first and second threaded end portions 32 and 34 and adapted to be received and rotated by an appropriate tool (not shown).

Figure 7A:
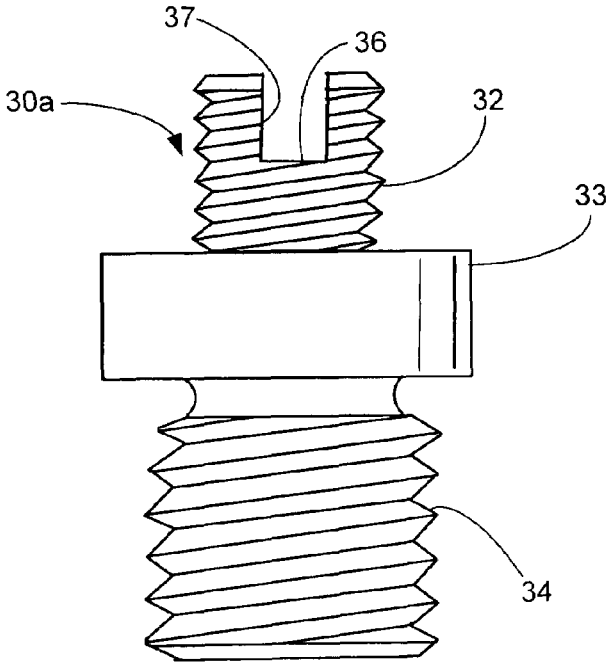
FIGS. 7*a* and 7*b* show an alternative embodiment of the replaceable well stud.
Figure 7B:
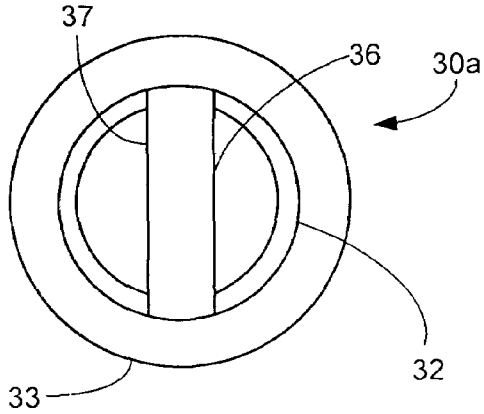
Figure 8A:
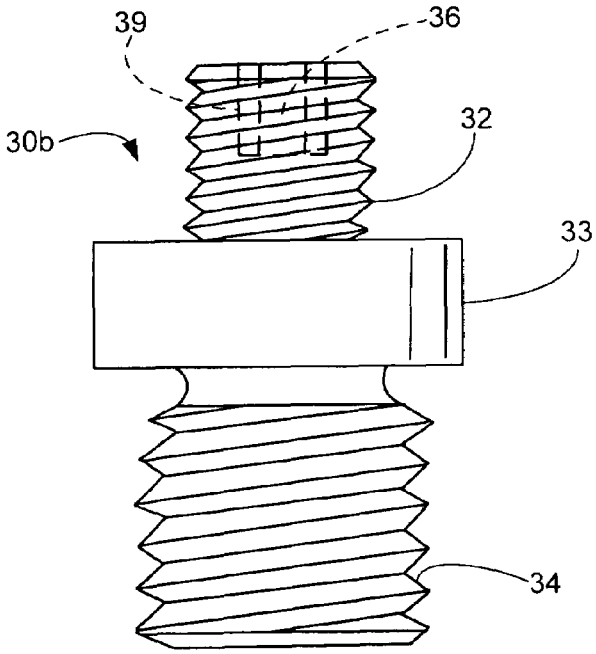
FIGS. 8*a* and 8*b* show another alternative embodiment of the replaceable well stud.
Figure 8B:
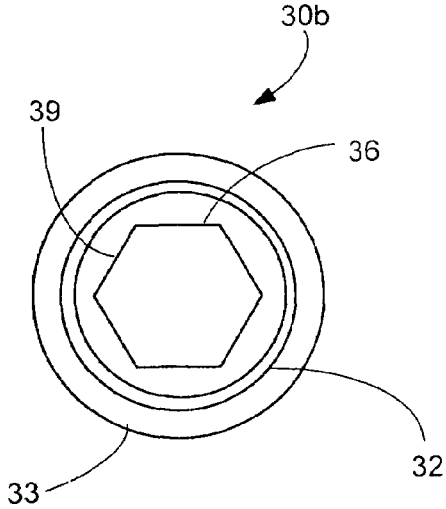

However, it is conceivable that the tool engagement portion 36 could take other forms. For example, a slot 37 or other recess can be formed in the end of the first threaded end portion 32 for engagement with a screwdriver, as shown in FIGS. 7*a* and 7*b*. Alternatively, the first threaded end portion 32 can be formed with an internal hexagonal socket 39 for engagement with an allen wrench, as shown in FIGS. 8*a* and 8*b*. In any form, the tool engagement portion 36 allows the stud 30 to be coupled mechanically and electrically to the contact insert 20 of the bushing well 10.

Assembly of the bushing insert with the bushing well 10 is accomplished in the conventional manner, with the threaded end portion 32 of the well stud 30 engaging a threaded aperture of an electrical contact element of the bushing insert to complete the mechanical coupling and electrical connection between the bushing insert and the bushing well 10. Disassembly of the bushing insert from the bushing well 10, again, is accomplished in the conventional manner merely by unthreading the connection between well stud 30 and the bushing insert aperture. Should the well stud 30 break, however, either by over tightening or seizure of the threads, the stud alone can be easily replaced without having to replace the entire bushing well 10.

The well housing 12 of the present invention further preferably includes a semi-conductive rubber sleeve 40 integrally molded into the shoulder portion 16 of the housing. The rubber sleeve 40 preferably extends over a substantial axial length of the housing shoulder portion 16 so as to form a substantial amount of the entire external surface of the shoulder portion. Substituting a semi-conductive rubber sleeve 40 on the shoulder portion 16 of the well 10 provides greater durability to the well and less risk of damage upon handling, as compared to metalized epoxy material wells.

Figure 6:
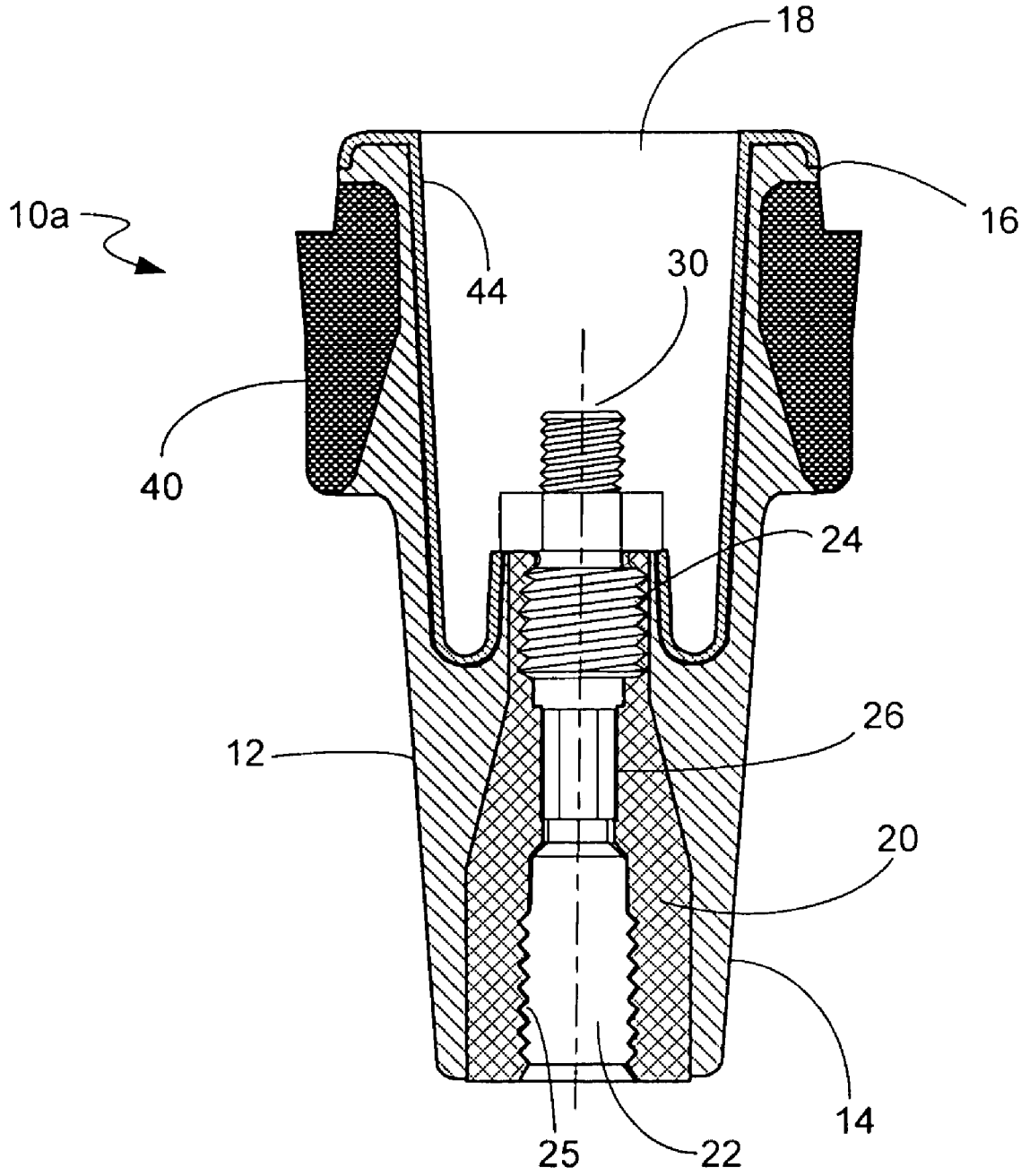
FIG. 6 is a cross-sectional view of an alternative embodiment of the bushing well formed in accordance with the present invention.

Furthermore, like the prior art well 100 described above, the shoulder portion 16 of the well 10 according to the present invention may be provided with or without one or more integrally molded bail tabs 42 adapted to engage a hold down bail to enhance attachment between the well 10, the bushing insert and an elbow. FIGS. 3-5 illustrate a bushing well 10 with such tabs 42 and FIG. 6 illustrates a well 10*a* without such tabs. It has furthermore been found that providing the relatively larger rubber sleeve 40 of the present invention improves the holding strength of the tabs 42 to the well 10. Thus, the rubber sleeve 40 of the present invention provides an added benefit.

Also in a preferred embodiment, an interface shell 44 is disposed within the internal cavity 18 of the housing 12 to reduce the frictional forces encountered upon assembling and disassembling the bushing insert with the well 10. The interface shell 44 also reinforces and/or strengthens this portion of the well 10.

An interface shell of this type is disclosed in commonly owned U.S. Pat. No. 6,939,151, the disclosure of which is incorporated herein by reference in its entirety for all purposes. Specifically, the shell 44 is a cup-shaped, thin-walled member molded from a low coefficient of friction plastic material, such as glass-filled nylon, and is disposed in the conical internal cavity 18 of the housing 12 to reduce frictional forces between the interface surfaces of the insert and the well 10 upon insertion and removal of the insert into and from the well. The separately molded shell 44 may be formed, for example, by injection molding, blow molding or spin molding.

The shell 44 may be bonded to the inner surface of the conical internal cavity 18 with a suitable adhesive after both parts are molded. However, in a preferred embodiment, the insulative material of the well housing 12 is molded or extruded directly around a premolded shell placed within the housing mold.

Figure 11:
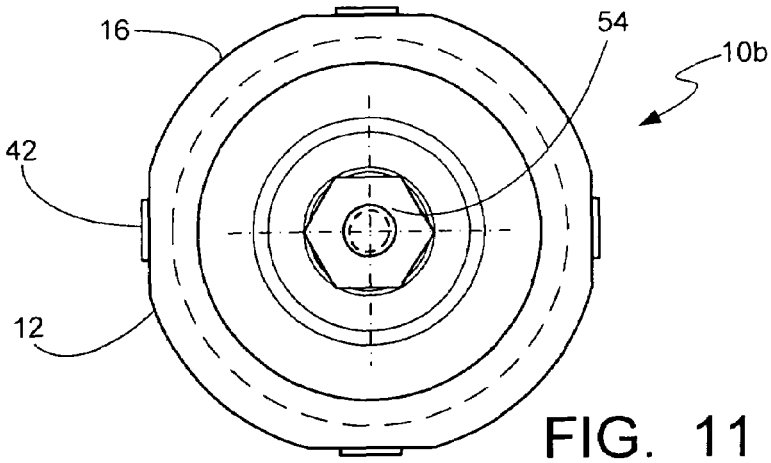
FIG. 11 is a top plan view of the bushing well shown in FIG. 9.
Figure 10:
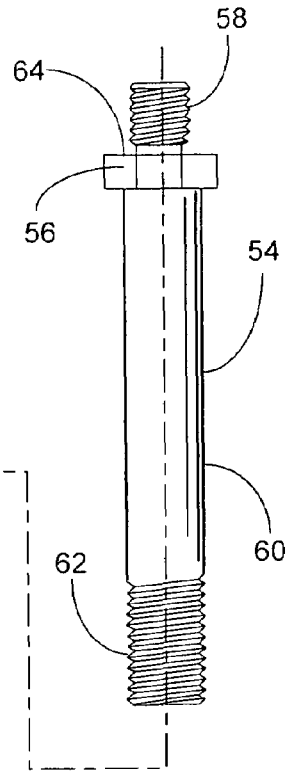
FIG. 10 is a side view of the well assembly bolt shown in FIG. 9.
Figure 9:
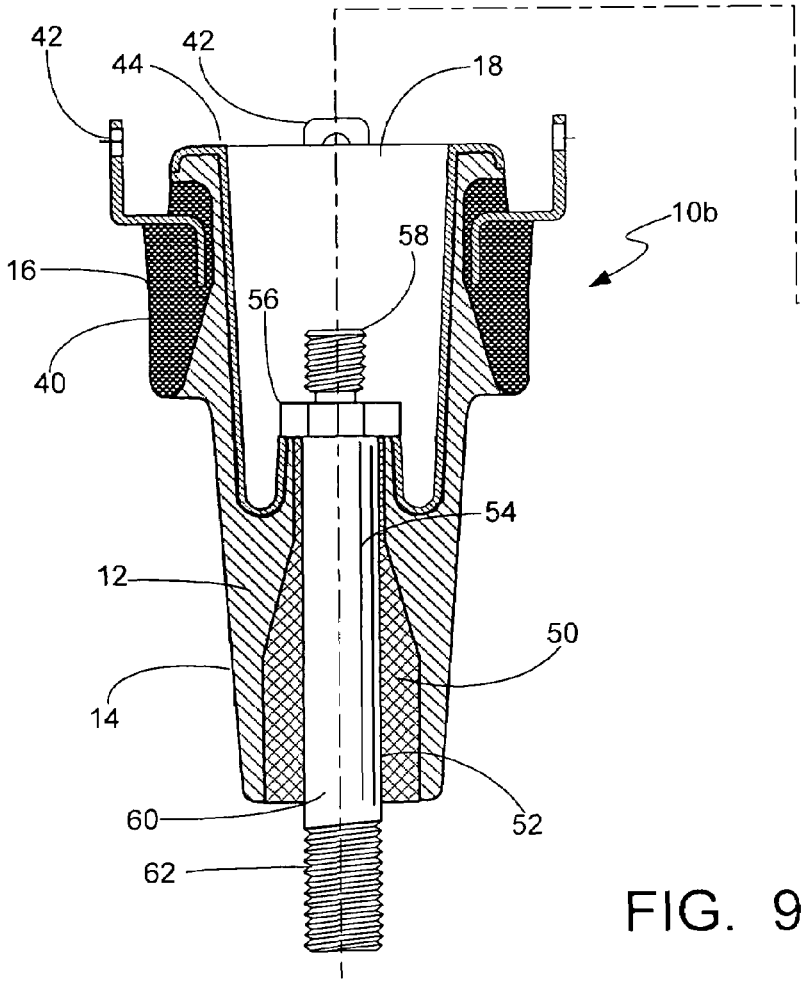
FIG. 9 is a cross-sectional view of another alternative embodiment of the bushing well formed in accordance with the present invention.

Turning now to FIGS. 9-11, in an alternative embodiment, a bushing well 10*b* is provided with a contact insert 50 having an axial bore 52 formed therethough without any internal installation tool engagement structure. Instead, in this embodiment, the installation tool engagement structure 56 is provided on a replaceable well assembly bolt 54.

Specifically, a well assembly bolt 54 is provided, which includes a first externally threaded end 58 complementary to an internally threaded component of the bushing insert, as described above. Extending in the opposite direction from the first externally threaded end portion 58 is a shank 60, which extends into the axial bore 52 of the contact insert 50. At its end opposite the first internally threaded end 58, the shank 60 is provided with structure for engaging the electrical device to which the well 10*b* is to be mounted. FIGS. 9-10 show such structure in the form of an externally threaded end portion 62, which threadably engages an internally threaded aperture of the electrical device. Alternatively, the shank 60 can be provided with an internally threaded end portion to engage an externally threaded terminal of the electrical device.

The installation tool engagement structure 56 provided on the well assembly bolt 54 preferably takes the form of a hexagonal shoulder portion 64 disposed adjacent the first externally threaded end portion 58 so as to be accessible within the internal cavity 18 of the well housing 12 with a standard socket. However, here too, it is conceivable that the tool engagement portion 56 could take other forms, as described above with respect to the well stud 30*a*, 30*b* shown in FIGS. 7*a*, 7*b*, 8*a* and 8*b*. For example, a slot or other recess can be formed in the end of the first threaded end portion 58 for engagement with a screwdriver. Also, the first threaded end portion 58 can be formed with an internal hexagonal socket for engagement with an allen wrench, or other tool.

Upon installation, once the well 10*b* is properly seated within the electrical device, the well assembly bolt 54 can be inserted within the axial bore 52 of the contact insert. An installation tool is then placed within the internal cavity 18 of the well 10*b* and applied to the installation tool engagement structure 56 of the well assembly bolt 30. Driving the tool causes the well assembly bolt 30 to rotate within the axial bore 52 of the contact insert 50 so as to threadably engage mating structure of the electrical device. A bushing insert can then be inserted within the well cavity 10*b* and attached to the first externally threaded end portion 58 of the assembly bolt 54 in a conventional manner.

One benefit of the well 10*b* in this embodiment is that only the well assembly bolt 30 rotates during installation. The well 10*b* itself does not rotate. Thus, instead of having to overcome frictional forces encountered upon rotationally sliding the conical surface of the well insertion end 14 against the mating conical surface of an electrical device receptacle during installation, the well 10*b* can be simply and easily placed or dropped within the receptacle without rotation.

Figure 14:
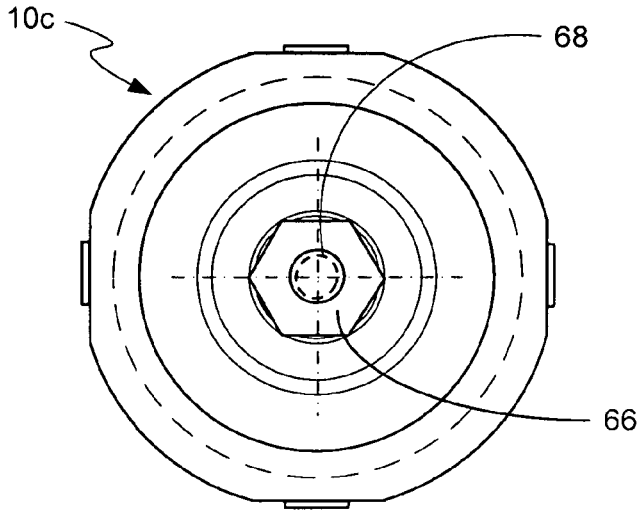
FIG. 14 is a top plan view of the bushing well shown in FIG. 12.
Figure 13:
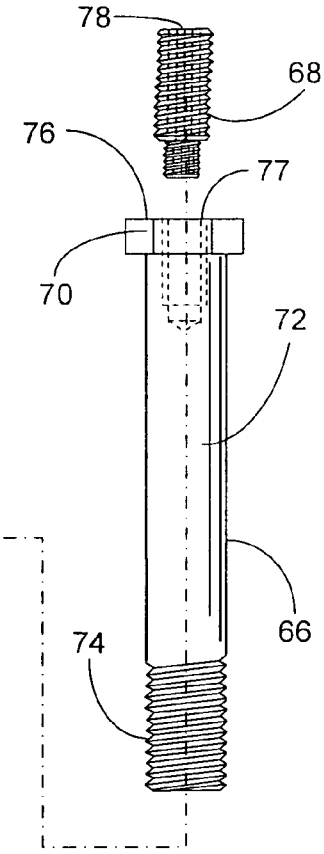
FIG. 13 is a side view of the well assembly bolt shown in FIG. 12.
Figure 12:
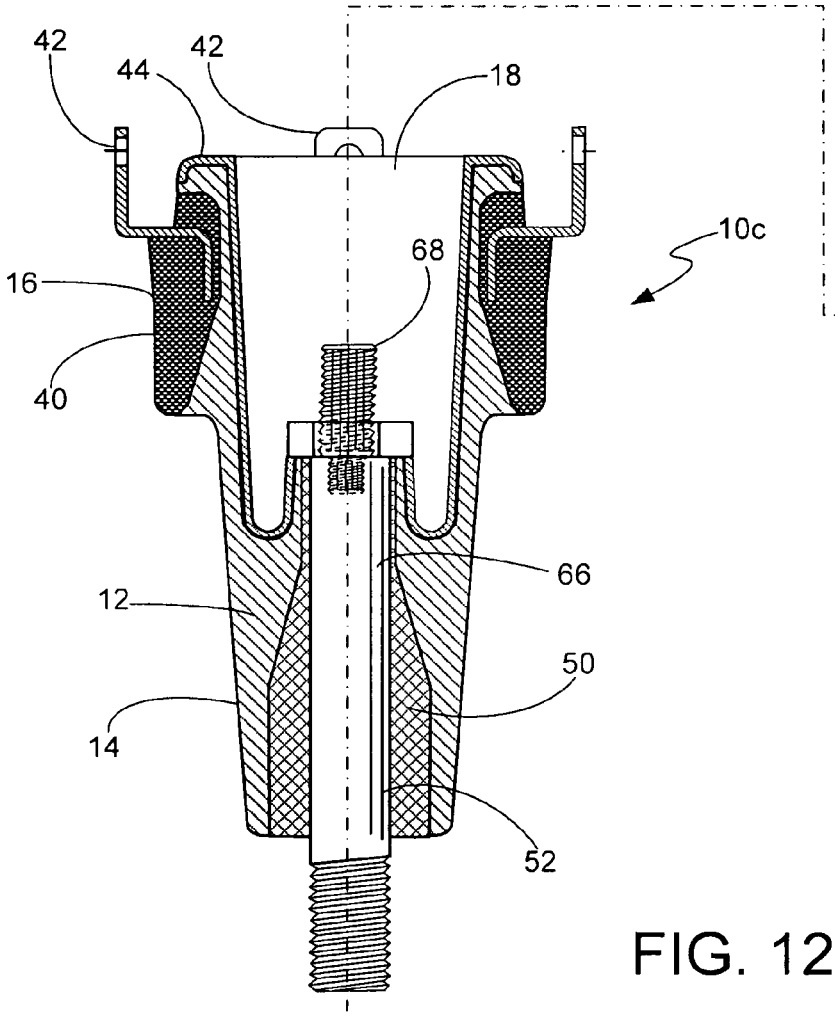
FIG. 12 is a cross-sectional view of a further alternative embodiment of the bushing well formed in accordance with the present invention.

Turning now to FIGS. 12-14, in another alternative embodiment, the well 10*c* is provided with a well stud assembly bolt 66, similar to the bolt 54 described above with reference to FIGS. 9-11, but in this embodiment, the bolt has a replaceable externally threaded end portion 68.

The bushing well 10*c* is again provided with a contact insert 50 having an axial bore 52 formed therethough without any internal installation tool engagement structure and, again, the installation tool engagement structure 70 is provided on the replaceable well assembly bolt 66. Also, the assembly bolt 66 is again provided with a shank 72 extending in the opposite direction from the installation tool engagement structure 70, and which extends into the axial bore 52 of the contact insert 50. The shank 72 is provided with structure for engaging the electrical device to which the well 10*b* is to be mounted. Such structure can take the form, for example, of an externally threaded end portion 74, which threadably engages an internally threaded aperture of the electrical device. Moreover, the installation tool engagement structure 70 provided on the well assembly bolt 66 again preferably takes the form of a hexagonal shoulder portion 76 which is accessible within the internal cavity 18 of the well housing 12 with a standard socket wrench, or other tool.

However, in this embodiment, the bolt 66 is formed with an internally threaded aperture 77 adapted to engage a replaceable externally threaded end portion 68. The replaceable end portion 68 preferably takes the form of a threaded rod having an external thread complementary to both an internally threaded component of the bushing insert, as described above, and the internally threaded aperture 77. The threaded end portion 68 is further preferably formed with an internal hexagonal socket 78 extending therethrough for engagement with an allen wrench. However, it is conceivable that a slot or other recess can be formed in the end of the threaded end portion 68 for engagement with a screwdriver, or the end portion can be provided with a shoulder with an external hexagonal configuration for engagement with a socket wrench, or the like.

Installation can be achieved as described above, wherein the well 10*c* is first seated within the electrical device and the well assembly bolt 66 is inserted within the axial bore 52 of the contact insert. An installation tool is then placed within the internal cavity 18 of the well 10*c* and applied to the installation tool engagement structure 70 of the well assembly bolt 66 to cause the bolt to threadably engage mating structure of the electrical device. The end portion 68 is then attached to the bolt 66 and a bushing insert can then be attached to the end portion 68 in a conventional manner.

Figure 16:
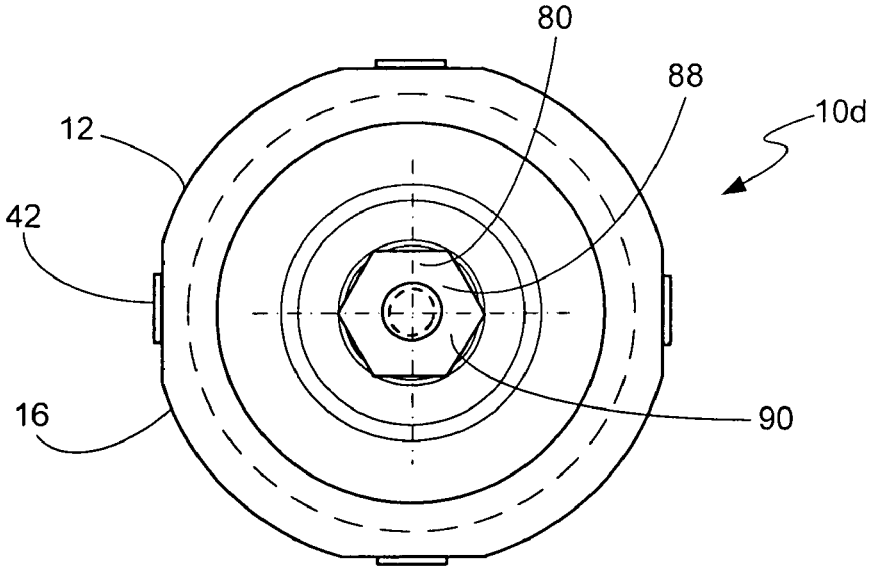
FIG. 16 is a top plan view of the bushing well shown in FIG. 15.
Figure 15:
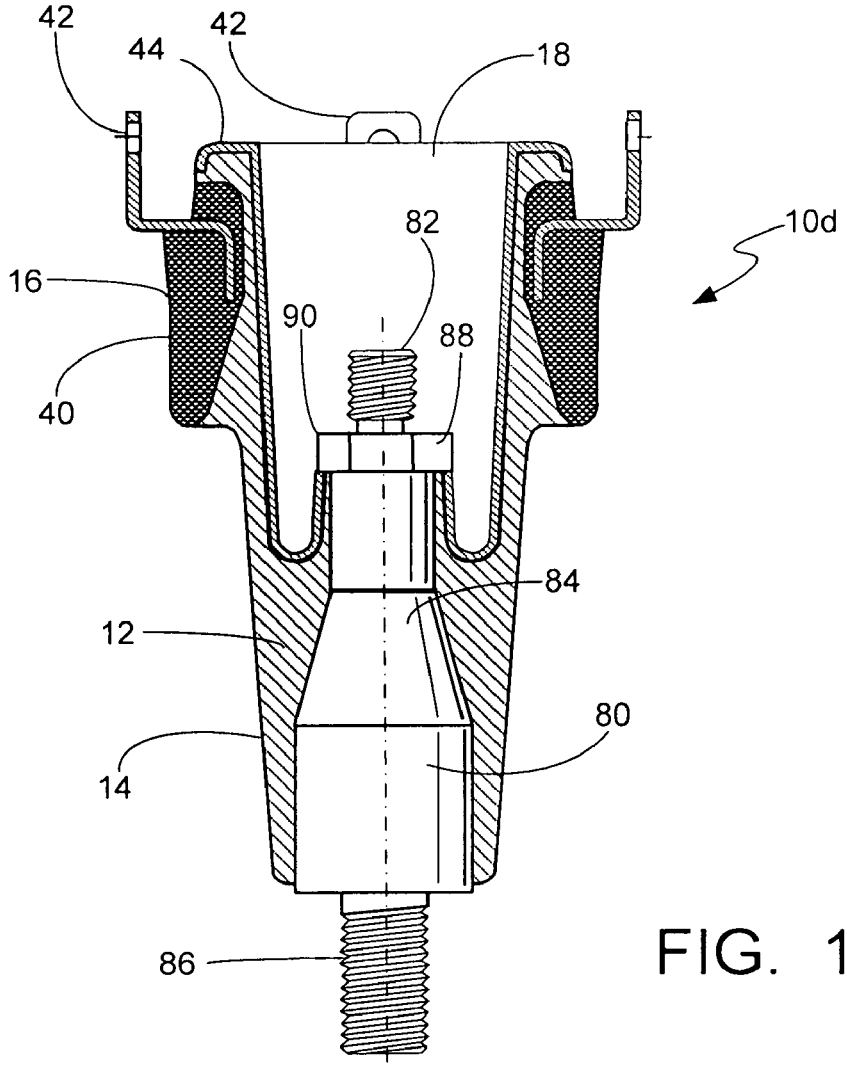
FIG. 15 is a cross-sectional view of still another alternative embodiment of the bushing well formed in accordance with the present invention.

In still another alternative embodiment, as described in FIGS. 15 and 16, a bushing well 10*d* is provided having a unitary contact insert/assembly bolt member 80. The unitary insert/bolt member 80 is integrally molded together with the well housing 12 so that the member becomes embedded or encapsulated with the insertion end 14 of the housing. The unitary insert/bolt member 80 includes a first externally threaded end 82 which extends into the internal cavity 18 of the well 10*d*. The external thread provided on the end portion 82 is complementary to an internally threaded component of the bushing insert, as described above. Extending in the opposite direction from the first externally threaded end portion 82 is a body portion 84 and provided at an end of the body portion opposite the first internally threaded end is structure for engaging the electrical device to which the well 10*d* is to be mounted. Again, FIG. 15 shows such structure in the form of an externally threaded end portion 86, which threadably engages an internally threaded aperture of the electrical device. Of course, the body 84 can be provided with an internally threaded end portion to engage an externally threaded terminal of the electrical device.

The unitary insert/bolt member 80 is also provided with installation tool engagement structure 88, which can take various forms. As shown in FIG. 15, the structure 88 preferably takes the form of a hexagonal shoulder portion 90 disposed adjacent the first externally threaded end portion 82 so as to be accessible within the internal cavity 18 of the well housing 12 with a standard socket. However, here too, it is conceivable that the tool engagement portion 88 could take the form of a slot or other recess formed in the end of the first threaded end portion 82 for engagement with a screwdriver, or an internal hexagonal socket formed in the end of the end portion for engagement with an alien wrench.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A bushing well comprising:

a bushing well housing defining a conical inner cavity for receiving an end of a bushing insert;

an electrically conductive insert disposed within said housing, said insert having an axial bore communicating with said conical inner cavity of said bushing well housing, said axial bore having a first internally threaded portion and an installation tool engagement portion, said installation tool engagement portion being defined by a wrenching passage provided in said axial bore, said wrenching passage having a hexagonal internal cross-section providing a wrenching socket accessible by an installation tool via said inner cavity of said housing for attaching the bushing well to an electrical device; and an externally threaded replaceable well stud threadably attached to said first internally threaded portion of said axial bore, said well stud having a first externally threaded end for engaging an internally threaded component of a bushing insert, a second externally threaded end opposite said first end for engaging said first internally threaded portion of said insert and a mid-section disposed between said first and second stud ends.

2. A bushing well as defined in claim 1, wherein said mid-section of said well stud comprises a radially enlarged hexagonal shoulder portion for engaging a well stud installation tool to tighten said well stud to said contact insert.

3. A bushing well as defined in claim 1, wherein said electrically conductive insert further comprises a second threaded portion opposite said first portion, said second threaded portion being accessible from outside said bushing well housing for engaging a threaded component of an external electrical device.

4. A bushing well as defined in claim 3, wherein said wrenching socket being disposed between said first and second threaded portions of said electrically conductive insert.

5. A bushing well as defined in claim 1, wherein said housing comprises:

a conically shaped insertion end made substantially of an insulating rubber; and a radially enlarged shoulder portion made substantially of a semi-conductive rubber.

6. A bushing well as defined in claim 5, wherein said shoulder portion comprises a semi-conductive rubber sleeve integrally molded within said housing, said sleeve covering substantially an entire outer surface of said shoulder portion.

7. A bushing well as defined in claim 5, further comprising a bail tab integrally molded in said semi-conductive rubber of said shoulder portion for enhancing attachment of an electrical component to said bushing well.

8. A method for securing a bushing well to an electrical device, the method comprising the steps of:

inserting a conically shaped insertion end of said bushing well into a mating connector of the electrical device;

inserting an installation tool into a conically shaped internal cavity of said well;

engaging said installation tool with an installation tool engagement portion provided in an axial bore formed in an electrically conductive insert disposed within said bushing well, said installation tool engagement portion being defined by a wrenching passage provided in said axial bore, said wrenching passage having a hexagonal internal cross-section providing a wrenching socket;

rotating said installation tool engaged with said wrenching socket to threadably engage said bushing well with said electrical device; and threadably attaching an externally threaded replaceable well stud to a first internally threaded portion of said axial bore to block access to said wrenching socket, wherein said well stud comprises a first threaded end for engaging a threaded component of a bushing insert, a second externally threaded end opposite said first threaded end for engaging said first internally threaded portion of said insert and a mid-section disposed between said first and second stud ends.

9. A bushing well comprising:

a bushing well housing defining a conical inner cavity for receiving an end of a bushing insert; and an assembly bolt disposed within said bushing well housing, said assembly bolt having a first externally threaded end extending into said conical inner cavity of said bushing well housing for engaging an internally threaded component of a bushing insert, a second threaded end opposite said first threaded end for engaging a threaded component of an electrical device, and a hexagonal shoulder portion disposed between said first and second ends, said hexagonal shoulder portion forming an installation tool engagement portion accessible by an installation tool via said inner cavity of said housing for attaching the bushing well to an electrical device;

wherein said assembly bolt comprises an externally threaded replaceable well stud threadably received in said assembly bolt, said externally threaded replaceable well stud forming said first externally threaded end of said assembly bolt;

a bail tab integrally molded in said semi-conductive rubber of said shoulder portion for enhancing attachment of an electrical component to said bushing well.

10. A bushing well as defined in claim 9, further comprising an electrically conductive insert disposed within said housing, said insert comprising a tubular member having an axial bore therethrough for receiving said assembly bolt.

11. A bushing well as defined in claim 9, wherein said housing comprises:

a conically shaped insertion end made substantially of an insulating rubber; and a radially enlarged shoulder portion made substantially of a semi-conductive rubber.

12. A bushing well as defined in claim 9, wherein said shoulder portion comprises a semi-conductive rubber sleeve integrally molded within said housing, said sleeve covering substantially an entire outer surface of said shoulder portion.

13. A method for securing a bushing well to an electrical device, the method comprising the steps of:

inserting a conically shaped insertion end of said bushing well into a mating connector of the electrical device, said bushing well defining a conically shaped inner cavity;

inserting an assembly bolt through a bore of said bushing well, said assembly bolt having a first externally threaded end extending into said conical inner cavity of said bushing well housing for engaging an internally threaded component of a bushing insert, a second threaded end opposite said first threaded end, and a hexagonal shoulder portion disposed between said first and second ends, said hexagonal shoulder portion forming an installation tool engagement portion;

inserting an installation tool into a conically shaped internal cavity of said well;

engaging said installation tool with said installation tool engagement portion of said assembly bolt; and rotating said installation tool to threadably engage said second threaded end of said assembly bolt with a threaded component of said mating connector to secure said bushing well with said electrical device.

14. A method as defined in claim 13, wherein said bushing well comprises a tubular electrically conductive insert having an axial bore therethrough for receiving said assembly bolt.

15. A method as defined in claim 13, wherein said assembly bolt comprises an externally threaded replaceable well stud threadably received in said assembly bolt, said externally threaded replaceable well stud forming said first externally threaded end of said assembly bolt.

16. A method as defined in claim 13, wherein said bushing well comprises a bushing well housing including a conically shaped insertion end made substantially of an insulating rubber and a radially enlarged shoulder portion made substantially of a semi-conductive rubber.

17. A method as defined in claim 16, wherein said shoulder portion comprises a semi-conductive rubber sleeve integrally molded within said housing, said sleeve covering substantially an entire outer surface of said shoulder portion.

18. A method as defined in claim 16, wherein said bushing well further comprises a bail tab integrally molded in said semi-conductive rubber of said shoulder portion for enhancing attachment of an electrical component to said bushing well.

* * * * *